United States Patent [19]

Appel

[11] 4,088,050

[45] May 9, 1978

[54] MOLDED PLASTIC TOY STRINGED INSTRUMENT

[75] Inventor: Mel Appel, Short Hills, N.J.

[73] Assignee: Proll Molding Co., Inc., Newark, N.J.

[21] Appl. No.: 727,167

[22] Filed: Sep. 27, 1976

[51] Int. Cl.[2] ..... G10D 1/08

[52] U.S. Cl. ..... 84/267; 46/175 R; 84/452 P

[58] Field of Search ..... 84/173, 267, 275, 291, 84/293, 452 P; 46/175

[56] References Cited

U.S. PATENT DOCUMENTS

| | | | |
|---|---|---|---|
| 2,588,101 | 3/1952 | Finder | 84/267 X |
| 3,964,362 | 6/1976 | Quemore | 84/275 |

*Primary Examiner*—Lawrence R. Franklin
*Attorney, Agent, or Firm*—Martin P. Hoffman; Geoffrey L. Chase

[57] ABSTRACT

A cast plastic toy having a unitary U-shaped body including the side and top walls of the sound box, a bridge, a neck, apertures in pegboard at one end of the neck, strengthening ribs, and a barrier at the juncture of the neck and sound box. A paperboard bottom wall completes the sound box, and pegs are inserted through the apertures in the pegboard. Strings extend between the pegs and the bridge, and a continuous ridge on the upper surface of the sound box receives a paperboard insert therewithin. Apertures are formed in the sound box, and simulated manual control buttons are located on the upper surface of the sound box.

1 Claim, 6 Drawing Figures

MOLDED PLASTIC TOY STRINGED INSTRUMENT

BACKGROUND OF THE INVENTION

1. Field of the Invention

This invention relates generally to toy stringed musical instruments, and more particularly to an improved molded toy instrument assembled from a minimum number of components.

2. Background of the Invention

Stringed instruments executed substantially in plastic are well known. For example, U.S. Pat. No. 1,881,229, granted Oct. 4, 1932, to Arthur P. Young, and U.S. Pat. No. 2,597,154, granted May 20, 1952, to Mario Maccaferri, disclose representative plastic stringed instruments.

The stringed instrument in Young is assembled from several individually molded components, such as a frame, a neck, and a keyboard. Screws are used to join the frame to the neck, and the keyboard to the neck. In an alternative embodiment, the neck and the keyboard are molded as a single component. A diaphragm is secured to the open, upper side of the frame and a sounding board is secured to projections on the open, lower side of the frame. Frets are integrally formed on the keyboard, and strings extend longitudinally between metal hooks and pegs on the pegboard.

The stringed instrument in Maccaferri is also assembled from at least two individually molded components, such as a (1) unitary upwardly opening body, neck and head, and (2) a planar sounding board to cover the open side of the body. A fretted finger board fits into the unitary neck and head, and a bridge is secured transversely across the upper surface of the sounding board. The molded components are joined together by adhesive cements.

Additionally, U.S. Reissue Pat. No. 23,620, granted Feb. 24, 1953, to George A. Finder, shows a cast plastic musical instrument of simplified construction.

While the plastic stringed instruments described above are well suited for use as full sized instruments, they do not lend themselves well to reductions in size, weight and cost that must be realized in the production of an inexpensive, light-weight, child's toy.

SUMMARY

Thus, with the teachings of the prior art clearly in mind, the instant invention contemplates an inexpensive, lightweight and attractive musical toy characterized by a unitary cast plastic body, neck and pegboard. A transverse barrier is cast at the junction of the body and neck to prevent the removal of the paperboard bottom wall of the sound box, and strengthening ribs are defined in the reverse side of the neck. The ribs enable excess plastic to be eliminated from the casting so that the completed instrument can be easily held by a child.

Additionally, the frets, guide and bridge that are operatively associated with the plurality of strings of the instant invention are formed as integral components of the unitary casting.

Furthermore, the instant invention provides a sound box with a notched lip, hollow post and several braces to form a surface to which the paperboard bottom of the sound box can easily be glued.

Also, a continuous ridge on the upper surface of the sound box receives therewithin a colorful paperboard insert bearing the name of the manufacturer and other identifying indicia. Apertures communicating with the sound box, molded plastic buttons that imitate manual controls on electrified guitars, and the curved contour of the sound box all contribute to the esthetic appeal of the toy instrument.

Other favorable attributes and advantages attributable to the instant invention will become readily apparent from the following description of the drawings.

DESCRIPTION OF THE INVENTION

Figure 1:
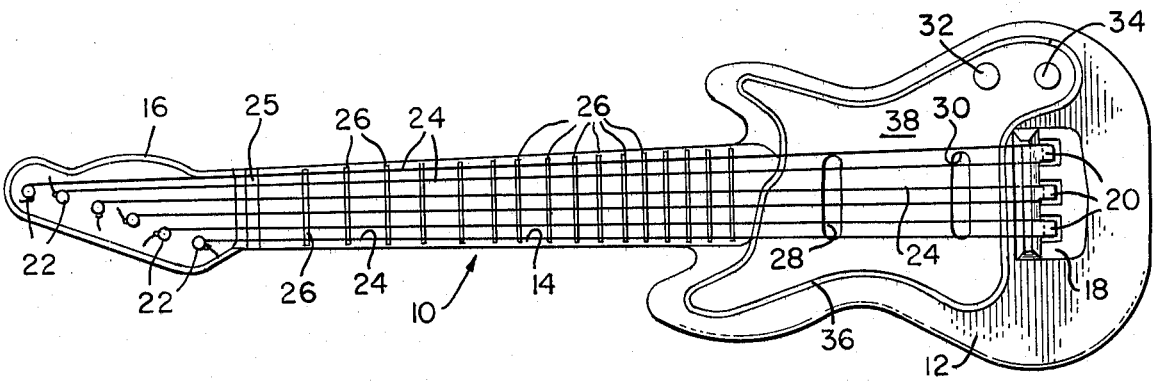
FIG. 1 is a top plan view of a toy stringed musical instrument constructed in accordance with the principles of this invention.

Turning now to the drawings, FIG. 1 shows the top surface of a toy stringed musical instrument 10 embodying the instant invention. Instrument 10 comprises a sound box 12 and a neck 14 that terminates at its free end in a pegboard 16. A bridge 18 with a plurality of projecting teeth 20 extends transversely across the upper surface of the sound box 12. A plurality of pegs 22 extend through apertures in the pegboard 16, and the ends of each of the strings 24 are threaded through apertures (not shown) in adjacent pegs, or are otherwise secured thereto. Although six strings are shown, only three discrete strings need be used, for the intermediate portion of each string is slipped under a projecting tooth 20. A guide 25 situated between the pegboard 16 and the neck 14 steadies the strings 24 as they pass between the bridge and the pegs 22.

Frets 26 are molded in the neck 14, and apertures 28, 30 extend through the top surface of the sound box 12 to establish communication therewith. Two "dummy" buttons 32, 34 are molded into the top surface, which emulate the control buttons on a full sized stringed instrument, such as an electric guitar. The sound box 12 curves inwardly in a fashion that parallels a full-sized stringed instrument.

A curved, continuous ridge 36 on the upper surface of the sound box 12 approximates the curvature for most of the sound box. A paperboard insert 38 fits within the confines of the continuous ridge. The insert 38 contains the name of the manufacturer of the toy instrument, and may contain other indicia. Openings in the insert coincide with the apertures 28, 30 in the sound box, and other openings slip over buttons 32, 34.

Figure 2:
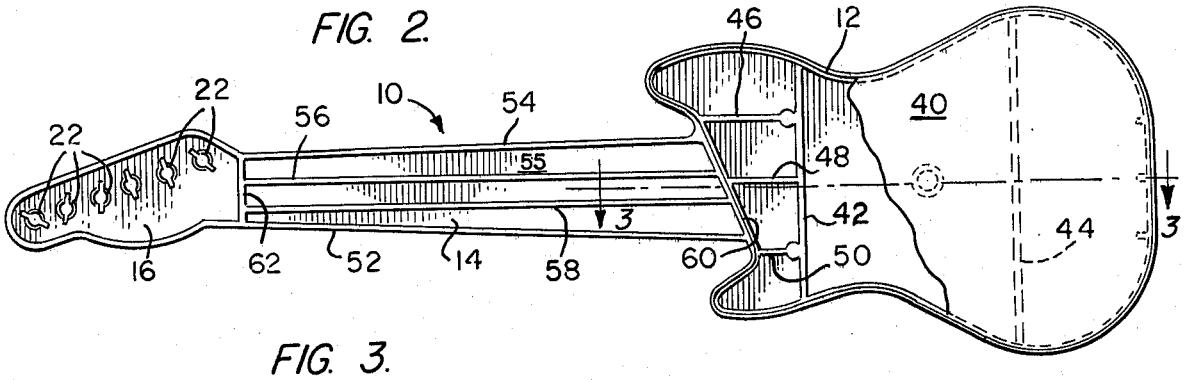
FIG. 2 is a bottom plan view of the toy instrument shown in FIG. 1.

FIG. 2 shows the bottom surface of the toy instrument 10, including the paperboard bottom wall 40 which seals the open bottom of the sound box 12. Transversely extending braces 42, 44 and shorter longitudinally extending braces 46, 48, 50 strengthen the sound box, and also provide a flat surface to which wall 40 is sealed.

The neck 14 is an inverted U-shaped component that opens downwardly for spaced side walls 52, 54 are joined together by a horizontal member 55. Ribs 56 and 58 extend along the length of the neck to rigidify and significantly strengthen same. A barrier 60 is formed at the junction of the neck 14 and the sound box 12, such barrier preventing the youthful user of the toy instrument from prying the wall 40 away from the sound box 12. A transverse member 62 is situated between the neck 14 and the pegboard 16.

Figure 3:
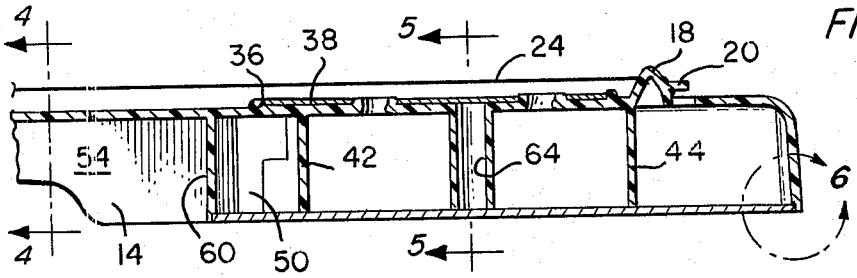
FIG. 3 is a cross-sectional view of the sound box and a segment of the neck of the toy instrument, such view being taken along line 3—3 in FIG. 2 and in the direction indicated.
Figure 4:
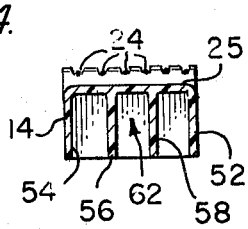
FIG. 4 is a vertical cross-sectional view of the neck of the toy instrument, such view being taken along line 4—4 in FIG. 3 and in the direction indicated.

FIG. 3 reveals that the neck 14 tapers outwardly in the vicinity of the sound box 12, and that a hollow post 64 is located centrally within the sound box. The guide 25 over which the strings 24 pass is best shown in FIG. 4. The same figure also points out the spacing of the side walls, ribs, and transverse member of the neck 14 of the toy instrument.

Figure 6:
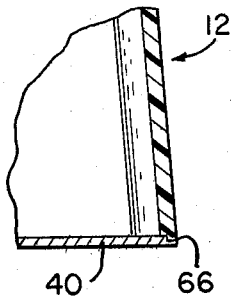
FIG. 6 is a detailed view, on an enlarged scale, of a corner of the sound box, such view being taken within the area indicated in FIG. 3.
Figure 5:
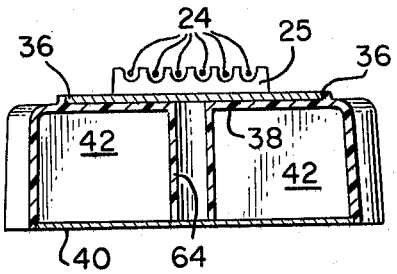
FIG. 5 is a vertical cross-sectional view of the sound box of the toy instrument, such view being taken along line 5—5 in FIG. 3 and in the direction indicated.

FIG. 5 shows the curvature of the sound box, as well as the relative heights of the border 36 and the guide 25. FIG. 6 shows that the bottom lip of the side box 12 is notched, as at 66, along its entirety. The paperboard bottom wall 40 fits into the notched lip, and may be secured thereto by adhesives. As noted previously, the wall 40 is also adhered to the plurality of braces situated within the sound box 12.

Various modifications in the instant toy instrument will become readily apparent to the skilled artisan from the foregoing disclosure. For example, although paperboard is probably best suited for the bottom wall of the sound box, other materials might be utilized. Hence, the appended claims should be liberally construed, and should not be limited to their literal terms.

I claim:

1. In a toy stringed musical instrument having a soundbox, a neck and a pegboard, the improvements comprising:

(a) said soundbox opening downwardly and including a planar top surface and integral continuous curved side walls wherein an integral barrier wall extends between the side walls of said neck at the junction of the neck and the soundbox, said barrier preventing access to a paperboard bottom wall of the soundbox;

(b) a bridge with integral guide and teeth situated on the top surface of said soundbox;

(c) said neck having a planar top surface with integral spaced side walls and integral longitudinal ribs, which in conjunction with integral transverse braces at the junction of the neck with the pegboard and with the soundbox, strengthen the instrument and resist torsional twisting;

(d) said pegboard, with integral side walls, having a plurality of pegs therein;

(e) said soundbox, said bridge, said neck, said pegboard and all of said sidewalls being executed in plastic as a unitary casting;

(f) a plurality of strings secured in tension between the pegs and the bridge for producing musical sounds; and (g) a paperboard bottom wall secured to the open side of the soundbox on the bottom edges of the side walls, on a central post integral with the soundbox and on a plurality of said integral braces to complete same.

* * * * *